US005976693A

United States Patent [19]

Miyoshi et al.

[11] Patent Number: 5,976,693

[45] Date of Patent: Nov. 2, 1999

[54] SYNTHETIC FIBER OF ACRYLIC SERIES WITH ANIMAL-HAIR FEELING

[75] Inventors: Masaaki Miyoshi, Takasago; Satoru Harada, Kakogawa; Ikuo Okino, Kobe, all of Japan

[73] Assignee: Kaneka Corporation, Osaka, Japan

[21] Appl. No.: 09/073,385

[22] Filed: May 6, 1998

[30] Foreign Application Priority Data

May 8, 1997 [JP] Japan ..... 9-117991
Apr. 14, 1998 [JP] Japan ..... 10-102328

[51] Int. Cl.[6] ..... D02G 3/00

[52] U.S. Cl. ..... 428/372; 428/400

[58] Field of Search ..... 428/364, 394, 428/400, 372

[56] References Cited

U.S. PATENT DOCUMENTS 4,254,182 3/1981 Yamaguchi et al. ..... 428/372
4,451,534 5/1984 Akagi et al. ..... 428/372
4,522,873 6/1985 Akagi et al. ..... 428/400
4,745,027 5/1988 Maeda et al. ..... 428/372

*Primary Examiner*—Newton Edwards
*Attorney, Agent, or Firm*—Armstrong, Westerman, Hattori, McLeland & Naughton

[57] ABSTRACT

A synthetic fiber of acrylic series having an excellent animal-hair feeling is provided. The surface of the fiber having unevenness, in which the center-line mean roughness of the outer periphery of the cross-section of the fiber lies within a range of 0.01 to 0.13 μm, is adhered thereon with an organopolysiloxane, wherein an effect by a treatment with silicone may be obtained to a greatest extent to provide the fiber having an extremely excellent animal-hair feeling. The kinds and amounts of additives to be added to a spinning solution may be so controlled that the roughness of unevenness on the surface of the fiber lies within the above range, thereby the appearance of the fiber with or without gloss may be selected. When the roughness of the surface unevenness lies within the above range and the cross-section of the fiber is a circle, or a flat or oval section having an aspect radio of 10 or less, a fiber having an extremely excellent animal-hair feeling may be obtained.

4 Claims, 8 Drawing Sheets

SYNTHETIC FIBER OF ACRYLIC SERIES WITH ANIMAL-HAIR FEELING

BACKGROUND OF INVENTION

1. Field of the Invention

The present invention relates to a synthetic fiber of acrylic series with a durability and an extremely excellent animal-hair feeling, and more particularly to a synthetic fiber of acrylic series in which presence/non-presence of gloss in the appearance and color of fibers may be arbitrarily selected and which has an excellent animal-hair feeling.

2. Description of the Related Art

Synthetic fibers of acrylic series, owing to their feeling and their easiness of finishing, have been considered hitherto as those having the most excellent animal-hair feeling among synthetic fibers, and used widely in the imitation field for imaging natural fur such as boa and seals and in the high-pile field. However, in comparison with natural furs, these synthetic fibers of acrylic series lack in the so-called sliminess in the feeling and previously a various processes have been performed to eliminate the disadvantage.

Hitherto, it has been well known that silicone such as organopolysiloxane is used as a treating agent to smooth the surface of synthetic fibers and to improve the feeling into the animal-hair feeling. For example, Japanese Patent Publication No. Sho 48-17514 describes a treatment with the combinations of amino-modified silicone and polyepoxide, epoxy-modified silicone and amine compound, epoxy-modified silicone and amino-modified silicone, and the like. Further, improved processes and treating agents based on the method described above are disclosed thereafter in Japanese Patent Publications Sho 51-37996, Sho 53-19715, Sho 53-19716 and so on.

However, even in the method described above, there cannot be obtained a sufficient animal-hair feeling.

SUMMARY OF THE INVENTION

An object of the present invention is to provide a synthetic fiber of acrylic series, in which the surface of fiber is smoothed by the silicone treatment as mentioned above, and has an excellent animal-hair feeling compared with the fibers in the prior arts.

As a result of an intensive study to attain the above-mentioned object, it has been found by the present inventors that a more excellent animal-hair feeling can be obtained by restricting the degree of surface unevenness of fibers, from a knowledge that the feeling is strongly influenced by the degree of surface unevenness of fibers in the silicone treatment.

Accordingly, the present invention provides a synthetic fiber of acrylic series with an animal-hair feeling which is characterized in that the synthetic fiber has an unevenness on the surface thereof, in which the center-line mean roughness of the outer periphery in the cross-section of fiber is in a range of 0.01 to 0.13 $\mu$m, and the surface of the fiber is adhered with an organopolysiloxane. When the surface unevenness lies within a range of 0.01 to 0.13 $\mu$m, the fiber may have an excellent animal-hair feeling irrespective of the presence/non-presence of color.

In the fiber having unevenness on the surface, in which the center-line mean roughness of the outer periphery of the cross-section of the fiber is in a range of 0.01 to 0.13 $\mu$m, the cross-section of the fiber may be preferably a circle or a flat or oval shape having an aspect ratio (long-/short-axis) of 10 or less. If the aspect ratio exceeds 10, a so-called toughness may not be provided, which is not preferable for the animal-hair feeling.

The center-line mean roughness of the outer periphery in the cross-section of the fiber of the present invention, which defines the degree of surface unevenness of fiber, means a value obtained by the following method: A 3-dimensional surface roughness analyzer (3-dimension SEM) is used and the center-line mean roughness on the line along the outer periphery in the cross-section orthogonal to the longitudinal direction of the fiber is determined as follows:

A 3-dimension SEM (ERA-8000, Erionix K.K.) is used in a magnification of 4,000 to determine the surface roughness of the fiber. The 3-dimensional uneven shape in the direction of X-, Y-and Z-axis on the surface of the fiber may be illustrated from the analysis, where the Y-axial direction is the longitudinal direction of the fiber, the X-axial direction is the direction along the outer periphery in the cross-section of the fiber among the directions orthogonal to the longitudinal direction of the fiber, and the Z-axial direction is the surface unevenness height direction orthogonal to both the longitudinal direction of the fiber and the direction along to the outer periphery in the cross-section of the fiber. In the present invention, the peripheral line in the cross-section of the fiber on the X-Z plane is defined as the line along the outer periphery in the cross-section orthogonal to the longitudinal direction of the fiber, the peripheral line being able to be taken arbitrary in any different position in the longitudinal direction of fiber. The line may be shown for example in FIGS. 1 to 8, in which the X-axis is in the direction along the outer periphery in the cross-section of the fiber orthogonal to the longitudinal direction of the fiber and the Z-axis is in the direction of unevenness height on the surface of the fiber. The center-line mean roughness means the center-line mean roughness defined in JIS-B 0601 in the line (sectional curve) shown in the figure.

The length of this line is at least 10 $\mu$m and the degree of the surface unevenness of the fiber is defined as a mean value of the center-line mean roughness of ten lines or more taken from the outer peripheries positioned differently in the longitudinal direction of the fiber.

The center-line mean roughness (Ra) defined by JIS-B 0601 as mentioned above is the value in $\mu$m obtained by the following equation when a portion having a length 1 to be determined is extracted in the direction of center-line from the roughness curve, and then the roughness curve is expressed by an equation y=f(x) and the center-line is expressed by an equation y=g(x), wherein the X-axis is the center-line of the extracted portion and the Y-axis is in the direction of longitudinal magnification:

$$R_a=1/1\int^{01}|f(x)-g(x)|dx \qquad \text{[Equation 1]}$$

In this case, the roughness curve means a curve in which the longer surface undulations than a given wave length is cut off from the cross-section curve, the center-line means a line wherein the area surrounded by the roughness curve and the line parallel to the mean line of the roughness curve is same in both sides of the center-line, and the mean line of the roughness curve means a line which is a straight or curve line having a geometrical shape of the surface to be determined in the extracted portion of the roughness curve, and is so defined that the sum of square of deviation from the line to the roughness curve may be minimum.

That is to say, in the present invention, the center-line mean roughness of the fiber before silicone treatment is set to be within a range of 0.01 to 0.13 $\mu$m. The center-line mean roughness of 0.01 $\mu$m or less provides an undesirable sticky feeling after silicone treatment, because the surface unevenness of the fiber is too small. The mean roughness beyond 0.13 μm remains still rough without animal-hair feeling after silicone treatment, because the surface roughness is too large. Preferably, it is within a range of 0.05 to 0.13 μm from the viewpoint of feeling, and more preferably, within a range of 0.05 to 0.10 μm, in which an extremely excellent animal-hair feeling of dry and soft touch may be obtained.

In general, in the production of synthetic fibers of acrylic series, various organic additives such as vinyl acetate, cellulose acetate, polymethylmethacrylate, polystyrene and the like as well as various inorganic additives such as $TiO_2$, $Sb_2O_3$, $Sb_2O_5$, and $Al(OH)_3$ are added to the spinning solution to control the whiteness, gloss and so on. The addition of pigment such as a carbon black or various dyes to the spinning solution may control the coloring and the shade of the fiber. Further, in a general wet-type spinning method, the surface unevenness of the fiber may be controlled by means of solvent concentration of coagulation bath, temperature and so on. According to the actions of these additives and spinning methods, the fibers having a surface unevenness of various degrees may be obtained and when the degree of surface unevenness is restricted within the range as mentioned above, the effect by the silicone treatment may be obtained to a great extent that a fiber having an extremely excellent animal-hair feeling is obtained.

When the degree of surface unevenness of fibers lies within the range as mentioned above, any kinds of additives, pigments, dyes and spinning methods may be used in the production of the fiber. Namely, the additives and so on are so selected that the degree of surface unevenness of fiber may be within the range as mentioned above to control the whiteness, gloss and shade. The silicone treatment of the surface of the fiber having a degree of surface unevenness within the range as mentioned above may provide the fiber having an extremely excellent animal-hair feeling which is an object of the present invention.

Further, in order to make the sectional shape of the fiber a circle, or a flat or oval shape having an aspect ratio of 10 or less, a nozzle of circular opening or a nozzle of flat or oval section, in which the long-/short-axis ratio is approximately 10 or less, may be used. While the fiber having a circular section, or a flat or oval section having an aspect ratio of 10 or less in the form of pile may have a suitable toughness and a preferred soft feeling. However, if the fiber in the form of pile exceeds 10 in an aspect ratio, the fiber may have no toughness and no preferred feeling.

BRIEF DESCRIPTION OF THE DRAWING

In the accompanying drawings

DETAILED DESCRIPTION OF THE PREFERRED EMBODIMENT

Figure 1:
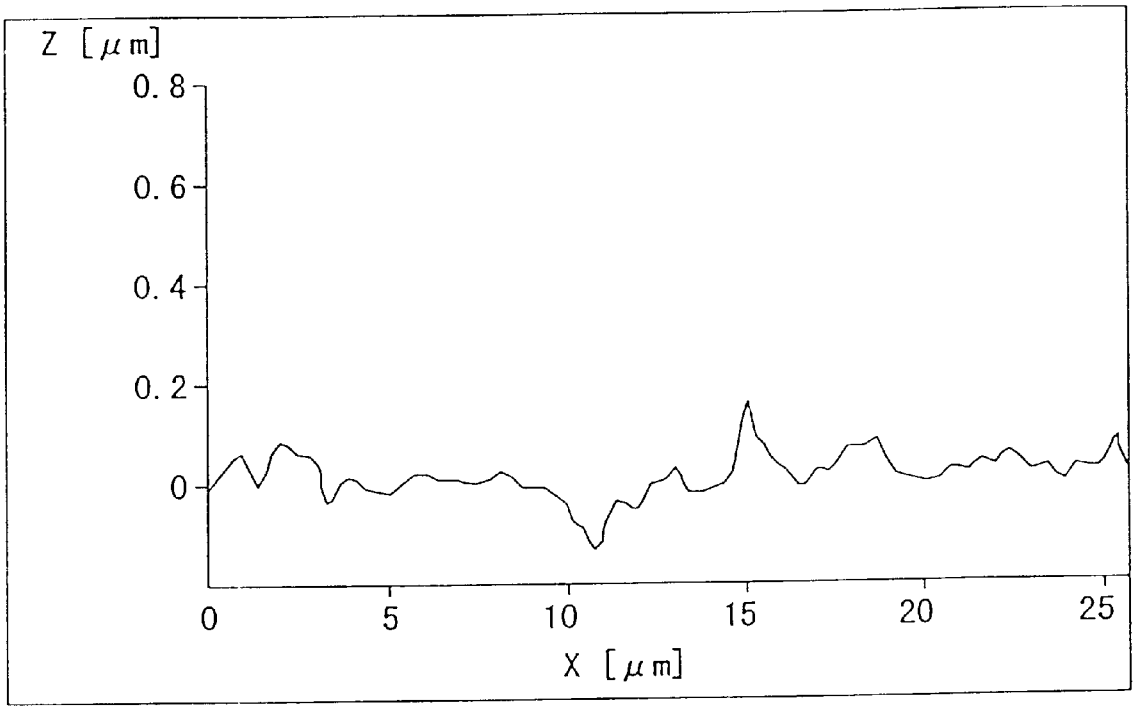
FIG. 1 is a graph obtained by the analysis of a shape of a portion of the outer periphery of the cross-section of a fiber in accordance with Example 1 of the present invention by a 3-dimensional surface roughness analyzer.

In order to produce a synthetic fiber of acrylic series according to the present invention, for example, a spinning solution in which a copolymer of acrylic series containing 30 to 70% by weight of acrylonitrile and 70 to 30% by weight of at least one other vinyl monomer copolymerizable with acrylonitrile is dissolved in an organic solvent, is added with various kinds of additives corresponding to desired whiteness, gloss, shade and the like, and then spun. At this time, the spinning method, the kinds of additives and the amount of additives to be added are adjusted so that the degree of surface unevenness of the fiber may be within the range as mentioned above.

In general, when the amount of additives to be added is increased, the degree of surface unevenness of the fiber becomes larger but inorganic particles having a smaller diameter have a relatively few influence on the surface of the fiber to be produced. As a result, the control of the degree of the surface unevenness within the range as mentioned above is facilitated. That is, even when the amount of inorganic additive having a small particle size to be added is increased to improve the whiteness, the degree of surface unevenness may be kept in a relatively small degree, and therefore it is possible to set the center-line mean roughness to 0.13 μm or less. For example, $TiO_2$ as a preferred additive to improve the whiteness has a relatively small particle size and a relatively little influence on the surface of the fiber. Accordingly, when the amount of addition is changed in accordance with the whiteness to be desired, it is easy to keep the degree of the surface unevenness within the range as mentioned above.

Vinyl monomers copolymerizable with acrylonitrile include vinyl chloride, vinylidene chloride, vinyl bromide, vinylidene bromide; acrylic acid ester, methacrylic acid ester; acrylamide, methacrylamide or mono- or dialkyl substituted compounds thereof; styrene or α, β-substituted styrene; vinyl acetate; vinyl pyrrolidone, vinyl pyridine or alkyl substituted compounds thereof; acrylic acid, methacrylic acid, itaconic acid, parastyrene sulfonic acid, 2,acrylamido-2-methyl propyl sulfonic acid, paramethacryloyloxybenzene sulfonic acid, methacryloyloxy-propyl sulfonic acid or their metal or amine salts.

The copolymers of acrylic series may be obtained in a common vinyl polymerization process by using as an initiator a known compound such as, for example, peroxide compounds, azo compounds or various kinds of redox compounds. The copolymer of acrylic series is dissolved in an organic solvent such as, for example, acetone, acetonitrile, dimethyl formamide, dimethyl acetamide, and dimethyl sulfoxide to form a spinning solution. Incidentally, if necessary, a stabilizer being effective for the rust prevention, coloring prevention, weather resistance and the like, may be added. An additive such as $TiO_2$ may be added to adjust the whiteness and gloss, however, it is necessary to adjust the amount to be added so that the degree of the surface unevenness of the fiber may be within the range as mentioned above.

The fineness of synthetic fiber of acrylic series is 1 to 30 denier, preferably 3 to 20 denier. The fineness of less than 1 denier provides a toughless feeling, and if the fineness exceeds 30 denier, a rough feeling may be provided due to too much toughness, adversely.

An organopolysiloxane is then adhered onto the surface of the synthetic fiber of acrylic series with the degree of the surface unevenness as mentioned above, to thereby yield the synthetic fiber of acrylic series with a given animal-hair feeling.

It is preferable to use as the organopolysiloxane at least one selected from dimethylpolysiloxane, amino-modified silicone, epoxy-modified silicone and carboxy-modified silicone.

The organopolysiloxane as mentioned above in the form of treatment solution is then adhered onto the surface of the fiber, which is then preferably subjected to a heat treatment at a temperature of 80° C. or higher to enhance the softening effect. The temperature of heat treatment is preferably 90° C. or higher, and more preferably 100° C. or higher.

The treatment solution containing mainly organopolysiloxane is preferably one in which the organopolysiloxane is emulsified with a surface active agent in water to adjust the viscosity and to obtain the stability upon the elapse of time. Since the treatment solution is loaded with a thermal and mechanical shear in the course of fiber production, the emulsion of organopolysiloxane should be so stable that it may not be destroyed by these shears. Further, to enhance the affinity for fibers, the emulsified treatment solution preferably may have a viscosity of 500 cp or less (at 25° C.).

The amount of organopolysiloxane adhered onto the surface of synthetic fiber of acrylic series is 0.01 to 0.7% by weight referred to the weight of fiber, preferably 0.03 to 0.5% by weight. The amount of less than 0.01% by weight provides a feeling of less sliminess, which does not give a good animal-hair feeling. If the amount thereof exceeds 0.7% by weight, it causes sticky feeling, which does not give an excellent feeling. The adhesion of organopolysiloxane may reduce the center-line mean roughness approximately by about 0.05 $\mu$m or less.

EXAMPLES

Examples according to the present invention will be illustrated hereinafter, which do not restrict the present invention. The evaluation method for the animal-hair feeling of synthetic fiber is described before the description of examples to explain the effect to which the present invention is aimed.

Evaluation of Animal-Hair Feeling: Sensual Evaluation

From a viewpoint of touch, a sensual evaluation is carried out by five judges using a short fiber and a pile knit, and then scored into five stages:

A feeling very similar to animal-hair: 5;
A feeling similar to animal-hair: 4;
A soft feeling: 3;
A feeling poor than 3: 2; and
A feeling poor than 2: 1.

Example 1

100 Parts by weight (hereinafter, part means part by weight) of copolymer (hereinafter referred to as copolymer A) consisting of 49.5 parts of acrylonitrile, 50 parts of vinyl chloride and 0.5 part of sodium styrenesulfonate is dissolved into 250 parts of acetone to obtain a spinning solution (A). The spinning solution (A) is added with cellulose acetate in an amount of 1% by weight referred to the copolymer A, and then spun through an oval nozzle having an aspect ratio of 5 into an aqueous 35% acetone solution at 25° C., washed with water, dried, stretched and treated with heat to yield a synthetic fiber of acrylic series with a stretching of seven times. The center-line mean roughness of the outer periphery in the cross-section of the fiber is analyzed by a 3-dimensional surface roughness analyzer (3-dimension SEM) to yield a mean roughness of 0.018 $\mu$m. The filaments of the fiber are dipped in an aqueous emulsion of 2% by weight of amino-modified silicone having an amino equivalent of 2,000 emulsified with 2% by weight of nonionic emulsifier (polyoxyethylenealkylether) at a viscosity of 400 cp (the amount of amino-modified silicone adhered: 0.3% owf) and then subjected to heat treatment (120° C. for 1 min) to yield silicone-treated fiber having an oval section of aspect ratio 5 and a final fineness of 6 denier.

Example 2

The same spinning solution (A) as in Example 1 is added with 0.2% by weight of $TiO_2$ referred to the copolymer A, and spun in the same manner as in Example 1. The center-line mean roughness on the outer periphery of the cross-section of the fiber obtained is 0.012 $\mu$m, which are treated with silicone in the same manner as in Example 1.

Example 3

The spinning solution (A) of Example 1 is added with 1% by weight of $TiO_2$ and 3% by weight of aluminum hydroxide referred to the copolymer (A), and spun in the same manner as in Example 1. The center-line mean roughness of the outer periphery of the cross-section of the fiber obtained is 0.056 $\mu$m, which are then treated with silicone in the same manner as in Example 1.

Example 4

The spinning solution (A) of Example 1 is added with 7% by weight of cellulose acetate referred to the copolymer A, and spun in the same manner as in Example 1. The center-line mean roughness of the outer periphery of the cross-section of the fiber obtained is 0.12 $\mu$m, which are then treated with silicone in the same manner as in Example 1.

Example 5

The spinning solution (A) of Example 1 is added with 0.2% by weight of $TiO_2$ and 2% by weight of a carbon black referred to the copolymer A, and spun in the same manner as in Example 1. The center-line mean roughness of the outer periphery of the cross-section of the fiber obtained is 0.035 $\mu$m, which are then treated with silicone in the same manner as in Example 1.

Example 6

The spinning solution (A) of Example 1 is added with 1% by weight of $TiO_2$ and 3% by weight of aluminum hydroxide and 2% by weight of a carbon black referred to the copolymer A, and spun in the same manner as in Example 1. The center-line mean roughness of the outer periphery of the cross-section of the fiber obtained is 0.061 $\mu$m, which are then treated with silicone in the same manner as in Example 1.

Example 7

The spinning solution (A) of Example 1 is added with 3% by weight of cellulose acetate and 1% by weight of $TiO_2$ referred to the copolymer A, and spun in the same manner as in Example 1. The center-line mean roughness of the outer periphery of the cross-section of the fiber obtained is 0.074 μm, which are then treated with silicone in the same manner as in Example 1.

Example 8

The spinning solution (A) of Example 1 is added with 3% by weight of cellulose acetate and 1% by weight of aluminum hydroxide referred to the copolymer A, and spun in the same manner as in Example 1. The center-line mean roughness of the outer periphery of the cross-section of the fiber obtained is 0.092 μm, which are then treated with silicone in the same manner as in Example 1.

Comparative Example 1

The spinning solution (A) of Example 1 is spun in the same manner as in Example 1. The mean value of center-line mean roughness of the outer periphery of the fiber obtained is 0.008 μm, which are then treated with silicone in the same manner as in Example 1.

Comparative Example 2

The spinning solution (A) of Example 1 is added with 10% by weight of cellulose acetate and 5% by weight of aluminum hydroxide referred to the copolymer A, and spun in the same manner as in Example 1. The center-line mean roughness of the outer periphery of the cross-section of the fiber obtained is 0.15 μm, which are then treated with silicone in the same manner as in Example 1.

Comparative Example 3

The spinning solution (A) of Example 1 is added with 10% by weight of cellulose acetate and 5% by weight of aluminum hydroxide and 2% by weight of a carbon black referred to the copolymer A, and spun in the same manner as in Example 1. The center-line mean roughness of the outer periphery of the cross-section of the fiber obtained is 0.17 μm, which are then treated with silicone in the same manner as in Example 1.

The center-line mean roughnesses of the outer periphery of the cross-section of the fibers obtained in Examples and Comparative Examples before and after silicone treatment are determined and the feeling and appearance of the fiber after silicone treatment is evaluated. The results are shown in Table 1.

Figure 2:
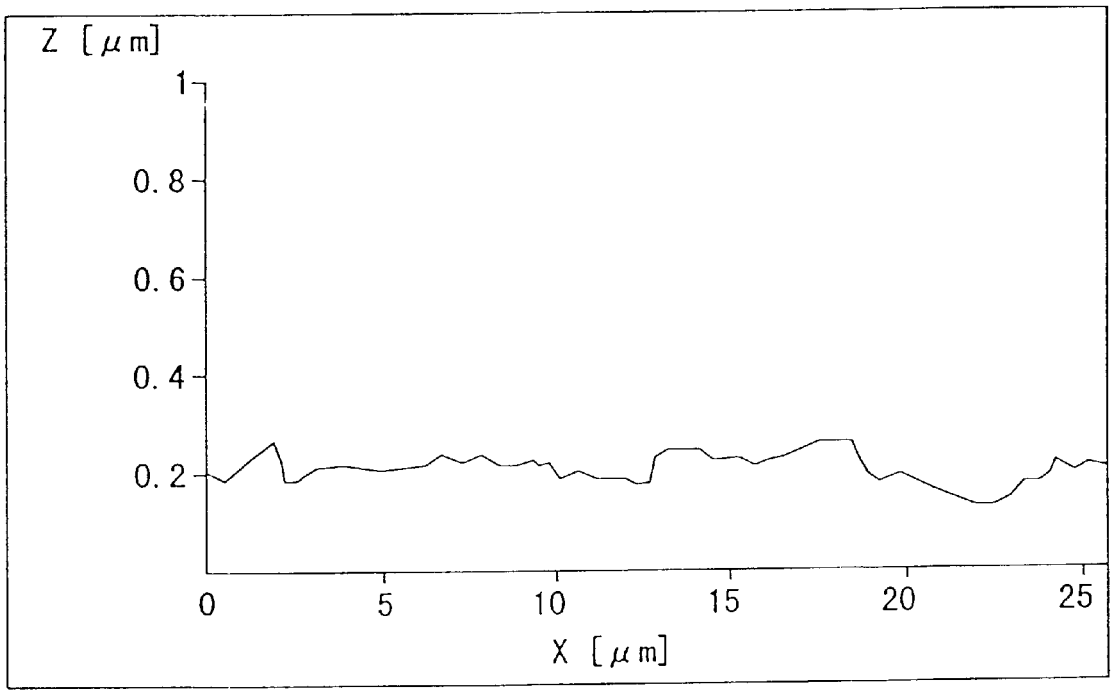
FIG. 2 is a graph obtained by the analysis of a shape of a portion of the outer periphery of the cross-section of a fiber in accordance with Example 2 of the present invention by the 3-dimensional surface roughness analyzer.
Figure 3:
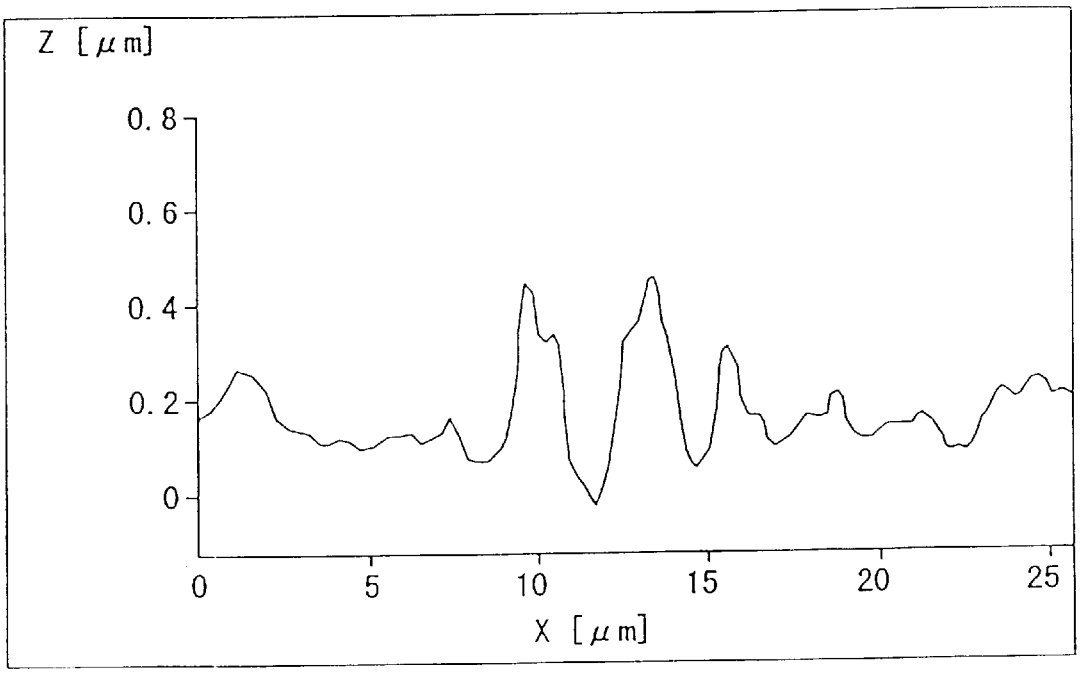
FIG. 3 is a graph obtained by the analysis of a shape of a portion of the outer periphery of the cross-section of a fiber in accordance with Example 3 of the present invention by the 3-dimensional surface roughness analyzer.
Figure 4:
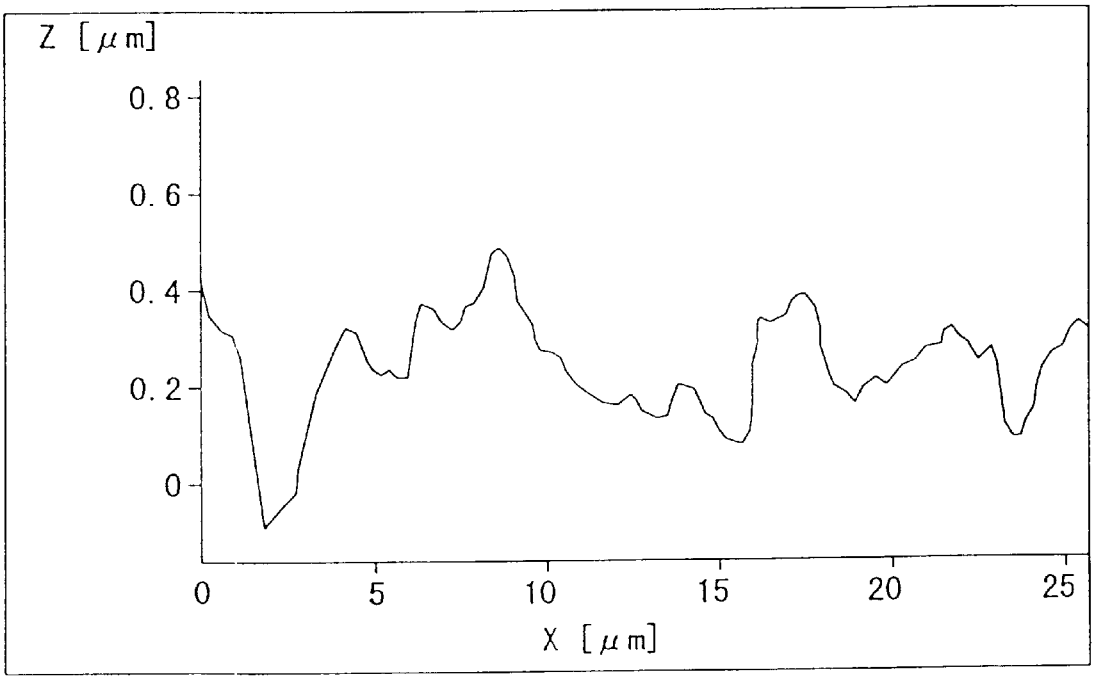
FIG. 4 is a graph obtained by the analysis of a shape of a portion of the outer periphery of the cross-section of a fiber in accordance with Example 4 of the present invention by the 3-dimensional surface roughness analyzer.
Figure 5:
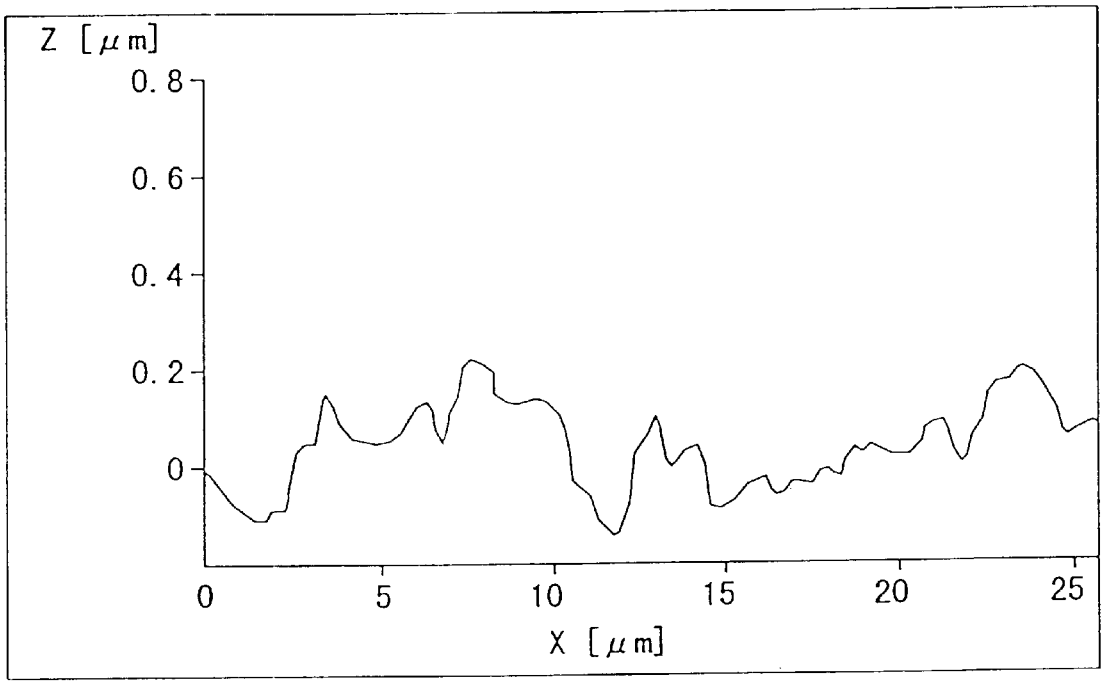
FIG. 5 is a graph obtained by the analysis of a shape of a portion of the outer periphery of the cross-section of a fiber in accordance with Example 5 of the present invention by the 3-dimensional surface roughness analyzer.
Figure 6:
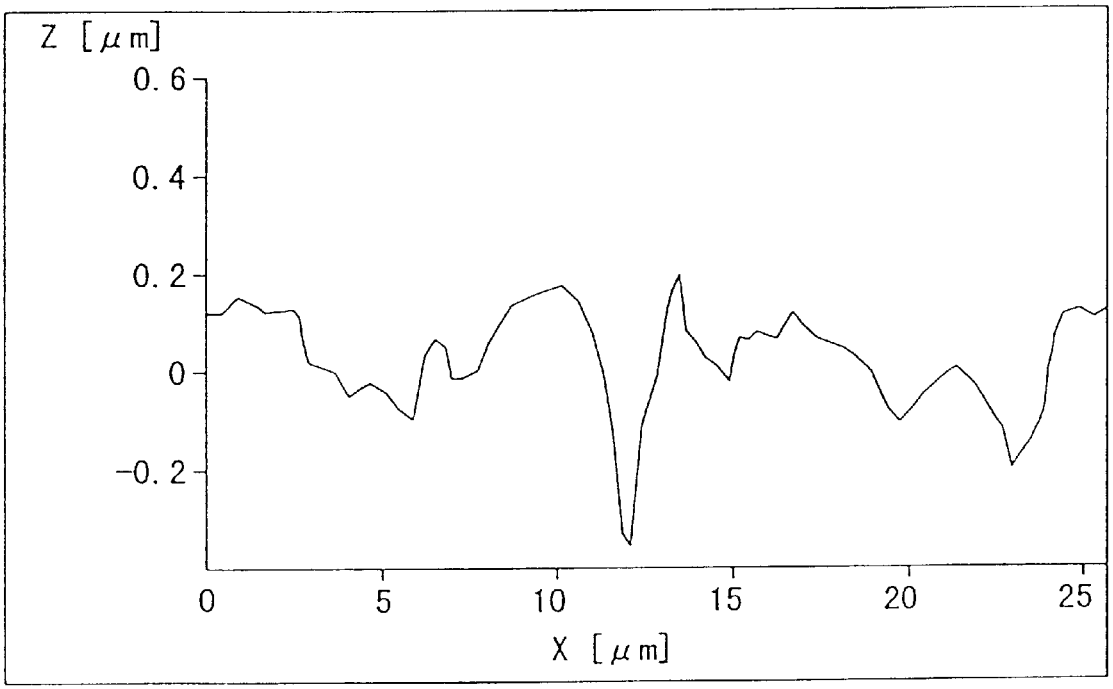
FIG. 6 is a graph obtained by the analysis of a shape of a portion of the outer periphery of the cross-section of a fiber in accordance with Example 6 of the present invention by the 3-dimensional surface roughness analyzer.
Figure 7:
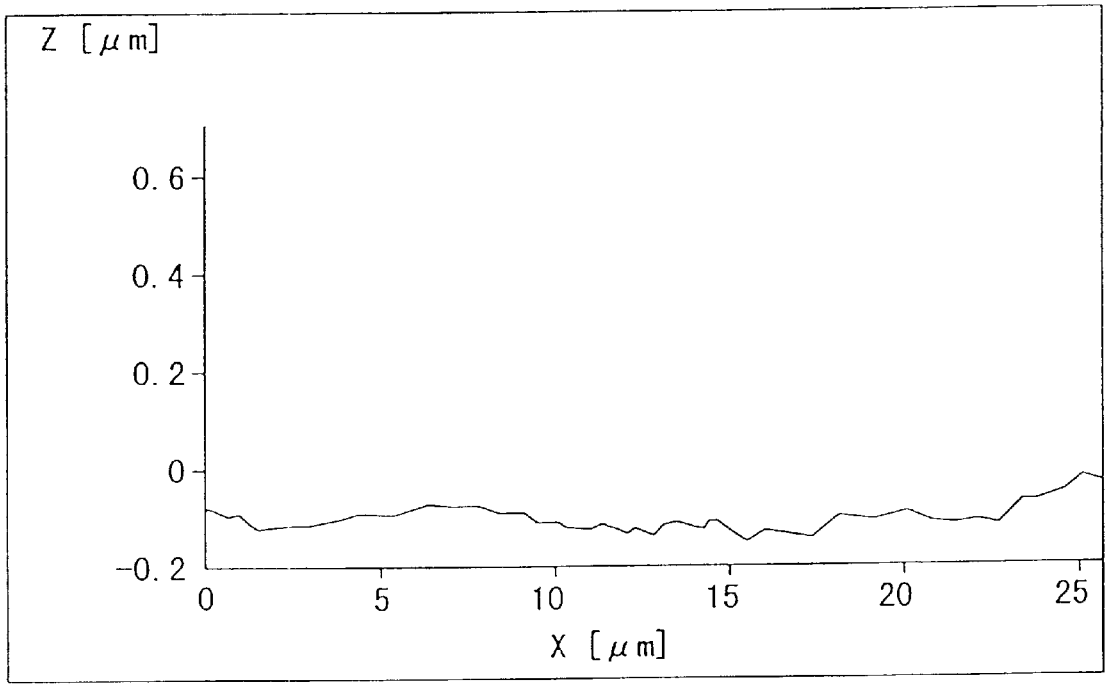
FIG. 7 is a graph obtained by the analysis of a shape of a portion of the outer periphery of the cross-section of a fiber in accordance with Comparative Example 1 of the present invention by the 3-dimensional surface roughness analyzer.
Figure 8:
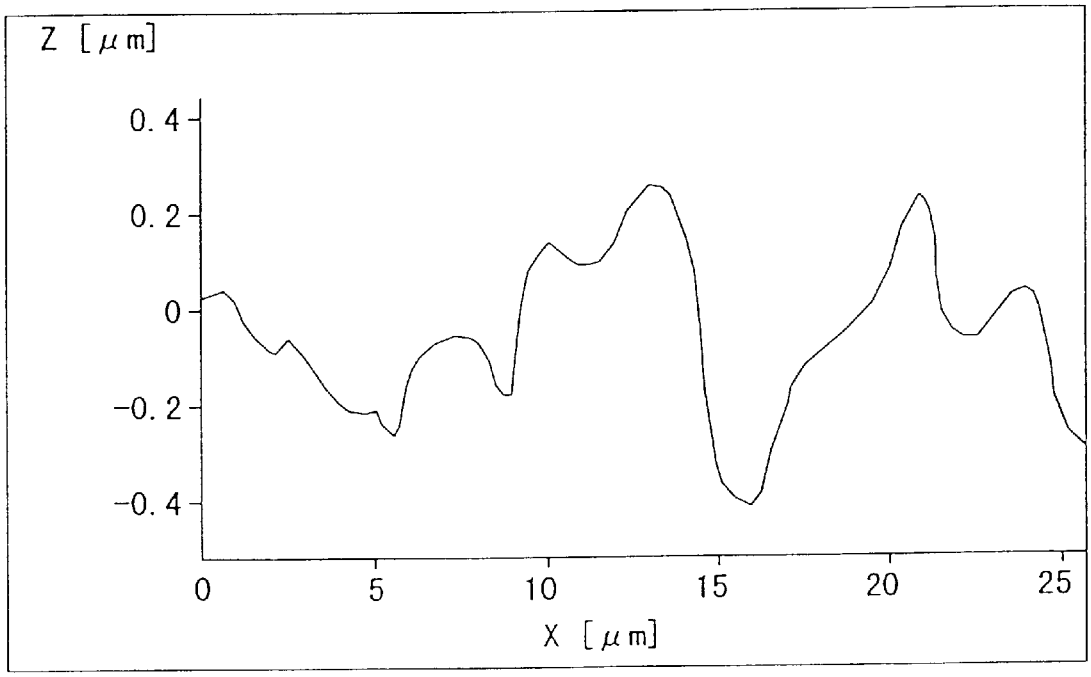
FIG. 8 is a graph obtained by the analysis of a shape of a portion of the outer periphery of the cross-section of a fiber in accordance with Comparative Example 2 of the present invention by the 3-dimensional surface roughness analyzer.

Further, the shapes of a part of the outer periphery of the cross-section of the synthetic fibers obtained in Example 1 to 6 and Comparative Examples 1 and 2 are analyzed by a 3-dimensional surface roughness analyzer (3-dimension SEM), and the results are shown in graphs of FIGS. 1 to 8.

Incidentally, in all of FIGS. 1 to 8, an X-axis represents an optional continuous portion of 25 μm wide in the outer periphery of the cross-section orthogonal to the longitudinal direction of the fiber and a Z-axis represents the height of the unevenness in the continuous portion.

TABLE 1

The relation between the center-line mean roughness of the outer periphery of the cross-section of the fiber and feeling/appearance

| | Center-line mean roughness of the outer periphery in the cross-section of fiber (μm) | Feeling | Appearance |
|---|---|---|---|
| Example 1 | 0.018 | 3 | With gloss |
| Example 2 | 0.012 | 3 | With gloss |
| Example 3 | 0.056 | 5 | No gloss |
| Example 4 | 0.12 | 4 | No gloss |
| Example 5 | 0.035 | 3 | With gloss |
| Example 6 | 0.061 | 5 | No gloss |
| Example 7 | 0.074 | 5 | No gloss |
| Example 8 | 0.092 | 5 | No gloss |
| Comparative Example 1 | 0.008 | 2 | With gloss |
| Comparative Example 2 | 0.15 | 2 | No gloss |
| Comparative Example 3 | 9.17 | 1 | No gloss |

The synthetic fibers of Examples 1 to 8 show an extremely excellent animal-hair feeling, whereas the synthetic fiber of Comparative Example 1 shows a slimy but sticky feeling, which dose not give an excellent feeling. The fibers of Comparative Examples 2 and 3 show rough feeling, which do not give an excellent animal-hair feeling.

Succeedingly, in order to evaluate a relationship between feeling and the sectional shape of the fiber, spinning is carried out while the shape of nozzle used in Examples 1 to 8 and Comparative Examples 1 to 3 is changed. The fiber thus obtained is evaluated.

Example 9

100 Parts by weight (hereinafter, part means part by weight) of the copolymer A is dissolved in 250 parts of dimethyl formamide (DMF) to obtain a spinning solution (B). The spinning solution (B)is added with the same additives as in Examples 1 to 8, and is spun through an oval nozzle into an aqueous 50% DMF solution at 20° C., then washed with water, dried, stretched and treated with heat to yield a synthetic fiber of acrylic series having a stretching of six times. The resulting fiber is then treated with silicone in the same manner as in Example 1 to yield a fiber (8 kinds) having a circular section and a final fineness of 6 denier.

Example 10

100 Parts by weight of copolymer (hereinafter referred to as copolymer B) consisting of 50 parts of acrylonitrile, 49 parts of vinylidene chloride and 1 part of sodium styrene-sulfonate is dissolved in 250 parts of dimethyl formamide (DMF) to obtain a spinning solution (C). The spinning solution (C) is added with the same additives as in Examples 1 to 8, and is spun through an oval nozzle having an aspect radio 5 into an aqueous 50% DMF solution at 20° C., then washed with water, dried, stretched and treated with heat to yield a synthetic fiber of acrylic series having a stretching of six times. The resulting fiber is then treated with silicone in the same manner as in Example 1 to yield a fiber (8 kinds) having an oval section of aspect radio 5 and a final fineness of 6 denier.

Example 11

100 Parts by weight of the copolymer B is dissolved in 250 parts of dimethyl acetamide (DMAC) to obtain a spinning solution (D). The spinning solution (D) is added with the same additives as in Examples 1 to 8, and is spun through a circular nozzle into an aqueous 50% DMAC solution at 20° C., then washed with water, dried, stretched and treated with heat to yield a synthetic fiber of acrylic series having a stretching of six times. The resulting fiber is then treated with silicone in the same manner as in Example 1 to yield a fiber (8 kinds) having a circular section and a final fineness of 6 denier.

Example 12

The same spinning solution (A) as in Examples 1 to 8 is added with the same additives as in Examples 1 to 8, and is spun through a circular nozzle into an aqueous 35% acetone solution at 25° C., then washed with water, dried, stretched and treated with heat to yield a synthetic fiber of acrylic series having a stretching of seven times. The resulting fiber is then treated with silicone in the same manner as in Example 1 to yield a fiber (8 kinds) having an oval section of aspect radio 3 and a final fineness of 6 denier.

Example 13

The spinning solution (A) is added with the same additives as in Examples 1 to 8, and then spun through an oval nozzle having an aspect radio of 5 in the same manner as in Example 10, and treated with silicone to yield a fiber (8 kinds) having an oval section of aspect radio 5 and a final fineness of 6 denier.

Example 14

The spinning solution (A) is added with the same additives as in Examples 1 to 8, and then spun through an oval nozzle having an aspect radio of 8 in the same manner as in Example 10, and treated with silicone to yield a fiber (8 kinds) having an oval section of aspect radio 8 and a final fineness of 6 denier.

Example 15

The spinning solution (A) is added with the same additives as in Examples 1 to 8, and then spun through an oval nozzle having an aspect radio of 10 in the same manner as in Example 10, and treated with silicone to yield a fiber (8 kinds) having an oval section of aspect radio 10 and a final fineness of 6 denier.

Comparative Example 4

The spinning solution (A) is added with the same additives as in Examples 1 to 8, and then spun through an oval nozzle having an aspect radio of 12 in the same manner as in Example 10, and treated with silicone to yield a fiber (8 kinds) having an oval section of aspect radio 12 and a final fineness of 6 denier.

In the evaluation of feeling of the synthetic fiber in the Examples and Comparative Examples described above, the fiber in Examples 9 to 15 each shows an extremely excellent animal-hair feeling in any case where any additives of Examples 1 to 8 are used, whereas the fiber in Comparative Example 4 shows a slimy but toughless feeling.

As described above, in the synthetic fiber of acrylic series according to the present invention, when an organopolysiloxane is adhered onto the surface of the fiber to provide an animal-hair feeling thereto, and the degree of the surface unevenness of the fiber to be adhered with organopolysiloxane is restricted to a given range, an effect owing to silicone (organopolysiloxane) may be realized to a greatest extent, resulting in a fiber having an extremely excellent animal-hair feeling. The kinds and amount of additives to be added to the spinning solution are controlled in such manner that the degree of the surface unevenness of the fiber may be within the range, so that the appearance with or without gloss of fiber may be selected. Further, when the degree of the surface unevenness lies within the above range and the sectional shape of the fiber is circular or a flat or oval section having an aspect radio of 10 or less, a fiber having an extremely excellent animal-hair feeling may be obtained.

What is claimed is:

1. A synthetic fiber of acrylic series with an animal-hair feeling, wherein said fiber has unevenness on the surface thereof and an organopolysiloxane is adhered onto the surface of said fiber in which a center-line mean roughness of the outer periphery of the cross-section of said fiber is within a range of 0.01 to 0.13 $\mu$m.

2. A synthetic fiber of acrylic series according to claim 1, wherein said synthetic fiber of acrylic series is colored in solution with dye and/or pigment.

3. A synthetic fiber of acrylic series according to claim 1 or 2, wherein the cross-section of said fiber is a circle.

4. A synthetic fiber of acrylic series according to claim 1 or 2, wherein the cross-section of said fiber is a flat or an oval shape having an aspect ratio (long-/short axis) of 10 or less.

* * * * *